United States Patent [19]

Banchetti

[11] Patent Number: 4,646,613

[45] Date of Patent: Mar. 3, 1987

[54] PRACTICAL STICK BASS

[76] Inventor: Paris Banchetti, 2800 S.W. 67 Ave., Miami, Fla. 33155

[21] Appl. No.: 730,524

[22] Filed: May 6, 1985

[51] Int. Cl.[4] ..... G10D 1/02

[52] U.S. Cl. ..... 84/327; 84/275; 84/280; 84/297 R; 84/309

[58] Field of Search ..... 84/1.16, 274–275, 84/280–281, 291, 297 R, 298–299, 307, 309, 327

[56] References Cited

U.S. PATENT DOCUMENTS

| | | | |
|---|---|---|---|
| 2,223,190 | 11/1940 | Smith | 84/1.16 |
| 2,455,452 | 12/1948 | Van Eps | 84/309 |
| 2,978,945 | 4/1961 | Dopera et al. | 84/309 X |
| 3,443,467 | 5/1969 | Richards | 84/307 |
| 3,910,151 | 10/1975 | Copeland | 84/267 |
| 4,235,143 | 11/1980 | Hoexter | 84/1.16 |
| 4,592,265 | 6/1986 | Steinberger | 84/327 |

FOREIGN PATENT DOCUMENTS

| | | | |
|---|---|---|---|
| 27976 | 11/1924 | France | 84/309 |
| 15851 | of 1901 | United Kingdom | 84/274 |

*Primary Examiner*—Lawrence R. Franklin

*Attorney, Agent, or Firm*—John Cyril Malloy

[57] ABSTRACT

The present invention is directed towards a stringed musical instrument of the type commonly known as a bass but particularly structured to have a reduced and variable overall dimension so as to facilitate transporting of the instrument and allow expansion of certain effective dimensions thereof such as the height (length) and width of the instrument to facilitate playing of the instrument in conventional positions such as standing and/or sitting and using conventional techniques.

13 Claims, 8 Drawing Figures

PRACTICAL STICK BASS

BACKGROUND OF THE INVENTION

1. Field of the Invention

A bass viol type musical instrument specifically structured to have its overall dimension and configuration reduced to facilitate transporting and incorporating structural components which serve to effectively enlarge and/or vary the width and/or height of the instrument so that it may be played in the conventional standing and/or sitting position.

2. Description of the Prior Art

Stringed musical instruments have been in existence and enjoyed wide popularity for literally hundreds of years. Such stringed instruments are considered desirable because of the musical sounds or tones which can be obtained during playing. Typically, this type of instrument incorporates one or more strings extending along the length of the instrument and in overlying relation to a sound box and extending or suspended upwardly therefrom by a bridge plate or like structure. The sound box is defined by a hollow interior body of the instrument specifically structured, dimensioned and configured to naturally amplify the acoustics produced by the vibrations of the strings when contacted by a bow or strummed by the fingers of the player. Again, while such instruments have enjoyed great popularity, there is a commonly recognized problem especially with the larger of such instruments. An example of such larger instruments is commonly referred to as a "bass." However, a more technical name for such a larger instrument would be a "bass viol" since it is the largest member of the viola family of musical instruments. Typically, the bass instrument is played while the musician stands alongside and in partial contact therewith. Also, the bass is played while the musician is in a sitting position, wherein such position is more common with smaller representations of the "bass."

However, commonly recognized problems with such instrument is the relatively large size and bulkiness of the instrument which prevents it from being readily transported or moved from one location to another as needed. Because of this large size, various means of public transportation are frequently not equipped to carry such instruments. In addition, these instruments can be comparatively expensive because of the overall size and the necessary workmanship required in the soundbox portion of the body.

Accordingly, there is a well recognized need in the prior art for an improved stringed musical instrument having an overall reduced size thereby making it readily transportable and positionable between any of a number of various locations. In addition, such a preferred instrument should have certain structural components which enable the variance of certain dimensional features and/or configurations of the instrument in order that it may be played in a conventional position or manner by the musician. In order to reduce the overall size, such a preferred instrument would not have the conventional music box including the hollow interior body portion. However, such could be compensated for by including electrical pickups which serves to amplify the vibrations of the plurality of strings of a given string assembly and thereby amplify the musical sounds or tones which are obtained by the vibration of the strings of the instrument.

A number of prior art instruments have recognized the above set forth problems existing with the type of stringed musical instrument or "bass" as set forth above. Accordingly, new instruments have been designed which attempt to overcome the bulkiness of the conventional acoustical bass in terms of structuring such instruments to be broken down, collapsed or otherwise reduced in overall dimension. However, some of these prior art instruments do not obtain the tonal quality even through the use of electrical pickups and further, such modified instruments are not capable of being played in the conventional position or orientation which is quite important to accomplished musicians.

The following U.S. patents are representative of prior art stringed musical instruments comprising a modified structure attempting to overcome the above set forth problems in the prior art: Taylor, U.S. Pat. No. 4,126,072; Grawi, U.S. Pat. No. 4,481,856; Ruggiero, U.S. Pat. No. 2,464,100; Zalinge, U.S. Pat. No. 4,242,938; Welch, U.S. Pat. No. 1,699,384; Dopera, U.S. Pat. No. 3,831,485; and De Lazaro, U.S. Pat. No. 2,539,297.

SUMMARY OF THE INVENTION

The present invention relates to a stringed musical instrument of the type commonly known as a "bass" but which includes structural modifications to vary the overall size and configuration so as to facilitate transporting of the instrument. At the same time, the structural features of the present invention allow its playing by a musician in a conventional standing or sitting position and/or engagement of the instrument in a normal manner. This enables the musician to utilize the same practiced techniques on the subject instrument that one would use on a conventionally sized acoustical bass.

More specifically, the subject musical instrument comprises a body preferably formed from a one-piece solid material construction such as wood or the like. A neck, having an elongated configuration, extends outwardly from the body in substantially coaxial relation thereto and a head portion is fixedly secured at the distal end of the neck in a conventional location. A bridge means including an outwardly extending bridge plate is secured to a front face of the body wherein the bridge plate rises above and extends outwardly from the front face in suspending, substantially interruptive engagement with one or more strings comprising a string assembly. The string assembly extends the length of the body including the neck and head portion. The string assembly comprises at least one but preferably a plurality of strings, in a conventional fashion, wherein each string is adjustably secured to a tuning peg movably mounted on the head portion and extending outwardly from an exposed face thereof in transverse relation thereto. The strings are of such a length to extend substantially the entire longitudinal dimension of the neck and body, from the head portion, and are interconnected or mounted on the opposite end of the body by virtue of a connecting means.

The connecting means comprises at least one and preferably a plurality of apertures, each of which passes through the opposite end of the body and is dimensioned to allow passage therethrough of one string of the string assembly. Each string is secured to the undersurface of the body adjacent the respective apertures and after passing therethrough. By virtue of this connecting means, a conventional floating anchor plate is eliminated from the subject structure.

A string tensioning means is provided between the bridge means and the connecting means and comprises an outwardly extending tension plate spaced from and disposed substantially parallel to the referred to bridge plate. The tension plate is also disposed in suspending, interruptive relation to the plurality of strings comprising the string assembly. However, the tension plate does not extend away from the front face as far as the bridge plate but does extend a sufficient distance to apply proper tension to the string at a location between the bridge plate and the connecting means or opposite end of the body. A fingerboard extends from the approximate junction of the head portion and the end of the neck downwardly to approximately the middle of the body portion in overlying relation to the front face thereof. This fingerboard is dimensioned substantially equal to a fingerboard found mounted on a conventionally sized acoustical bass and allows playing of the instrument in the same fashion and utilizing the same techniques by an accomplished musician as would be used with a conventional bass.

Tonal quality of the instrument is insured by virtue of the provision of the tensioning means and the manner in which the opposite end of the string assembly and the one or more strings comprising such assembly are attached to the opposite end of the body. This structural feature is provided due to the absence of a conventional floating anchor plate or tail plate normally used to secure the opposite ends of the string to the sound box of a body of a conventional bass.

Important structural features of the present invention include structural components utilized to expand the reduced width and length (height) of the instrument. This allows the instrument to be played in the conventional fashion and utilizing conventional techniques as if a musician would be playing a conventionally sized and structured bass. More specifically, a support means in the form of an elongated outwardly extendible rod is provided. The rod, in its collapsed or stored position, is disposed in telescoping relation within the interior of the body. The rod may be extended outwardly along its length such that the height or length of the instrument may be varied continuously until the full length of the supporting rod is fully extended from the bottom or opposite end of the body.

A width adjusting means is provided in the form of a pivotal arm wherein one end of the arm is pivotally secured to a side of the bass and the opposite end is movably positionable outwardly therefrom until the desired "effective" width of the instrument is accomplished. A detailed review of the structure of the subject instrument as disclosed herein of course indicates that the actual width of the body is not in fact increased. However, the outward positioning of the pivotally secured arm is meant to provide an engaging surface for the body of the musician playing the instrument and give the musician the feel of handling a conventionally sized acoustic bass. Therefore, the arm has an elongated, substantially curvilinear configuration which corresponds to the area of engagement of the body of the musician in the conventional fashion as with a normal acoustical bass.

Other structural features of the present invention include the provision of an electrical pickup assembly, commonly known in prior art stringed instruments, which amplifies the tone o musical sound of the string assembly especially in light of the absence of any soundbox or hollow interior of the body portion.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention reference is had to the following detailed construction considered in combination with the accompanying drawings, in which.

Like reference numerals refer to like parts throughout the several views of the drawings.

DETAILED DESCRIPTION OF THE PREFERRED EMBODIMENT

Figure 1:
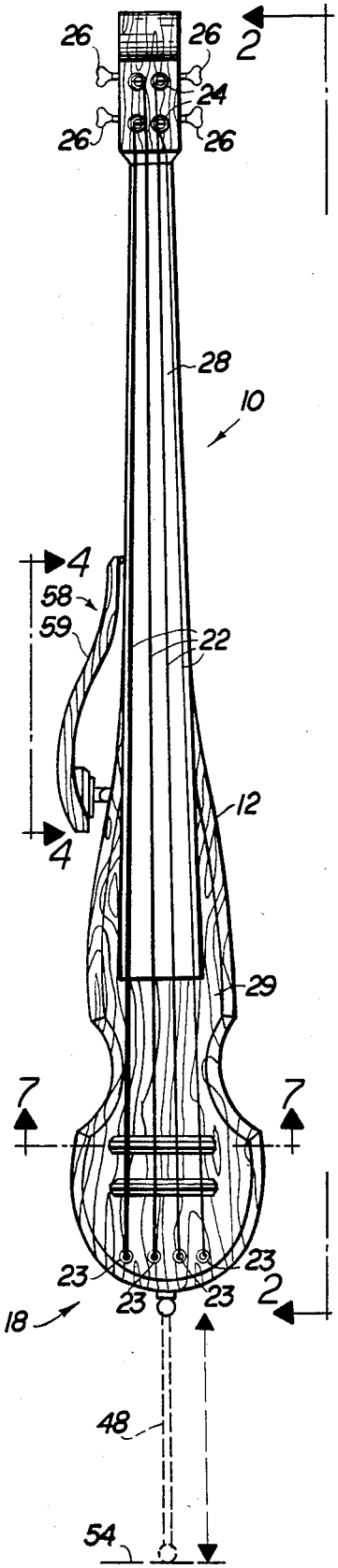
FIG. 1 is a front plan view of the stringed instrument of the present invention with a support rod, represented in broken lines, supporting the instrument and extending outwardly from the lowermost opposite end thereof.
Figure 2:
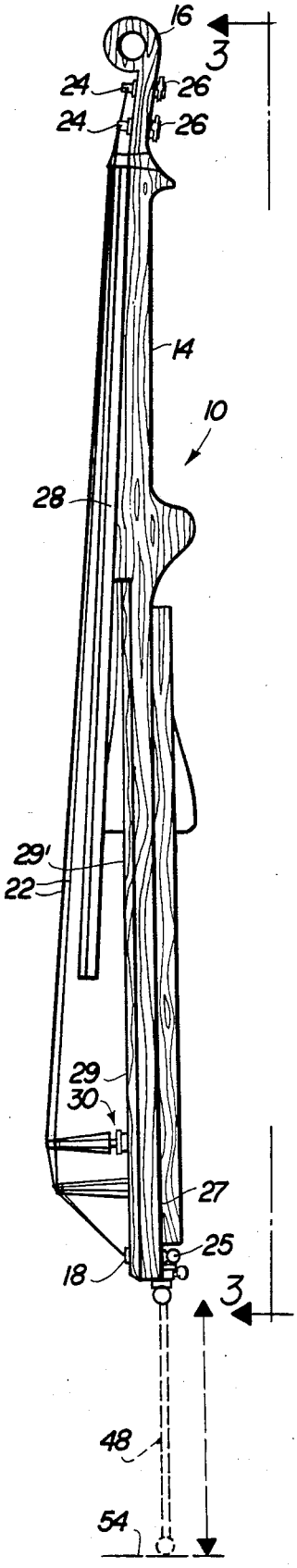
FIG. 2 is a side plan view along line 2—2 of FIG. 1.
Figure 3:
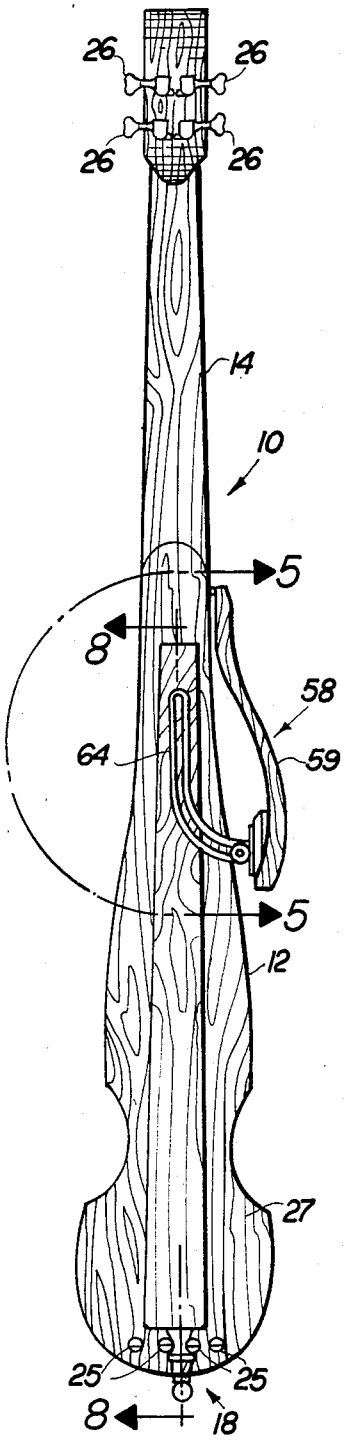
FIG. 3 is a rear view with the support rod shown in its collapsed or stored position.
Figure 4:
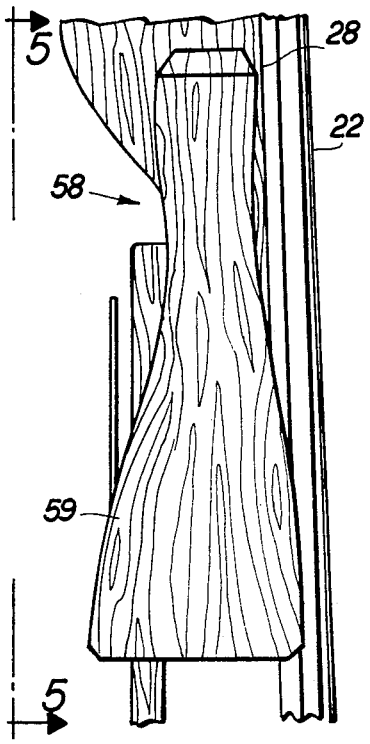
FIG. 4 is a detail view along line 4—4 of FIG. 1 showing the structure of a width adjusting arm secured to the body of the subject instrument.

As shown in FIGS. 1 through 3, the stringed musical instrument of the present invention is generally indicated as 10 and is structured to be of the type commonly known in the musical world as a bass and more technically referred to as a bass viol. The instrument 10 includes a body 12 including an elongated outwardly extending neck 14 integrally secured thereto. A head portion 16 is secured to the end of the neck 14 and defines one of two opposite ends of the body 12. The opposite end of body 12 is generally indicated as 18 and includes a connecting means in the form of at least one and preferably a plurality of through apertures 23 used to connect or mount one or more strings 22 at the opposite end 18 of the body 12. The one or more strings 22 define a string assembly which extends from the head portion 16 to the opposite end 18. More specifically, each of the strings 22 is secured to a tuning peg 24 extending transversely outwardly from the exposed face of the head portion 16. A thumb screw or like element 26 is rotatably interconnected to each of the tuning pegs 24 to cause their independent rotation and tightening or loosening of the attached ends of the individual strings 22. Each of the strings 22 passes through one of the plurality of apertures 23 which, as set forth above, extend through the opposite end 18 of the body. Connecting elements 25 serve to secure the correspondingly positioned end of each of the strings 22 to an undersurface 27 of the body 12.

Figure 7:
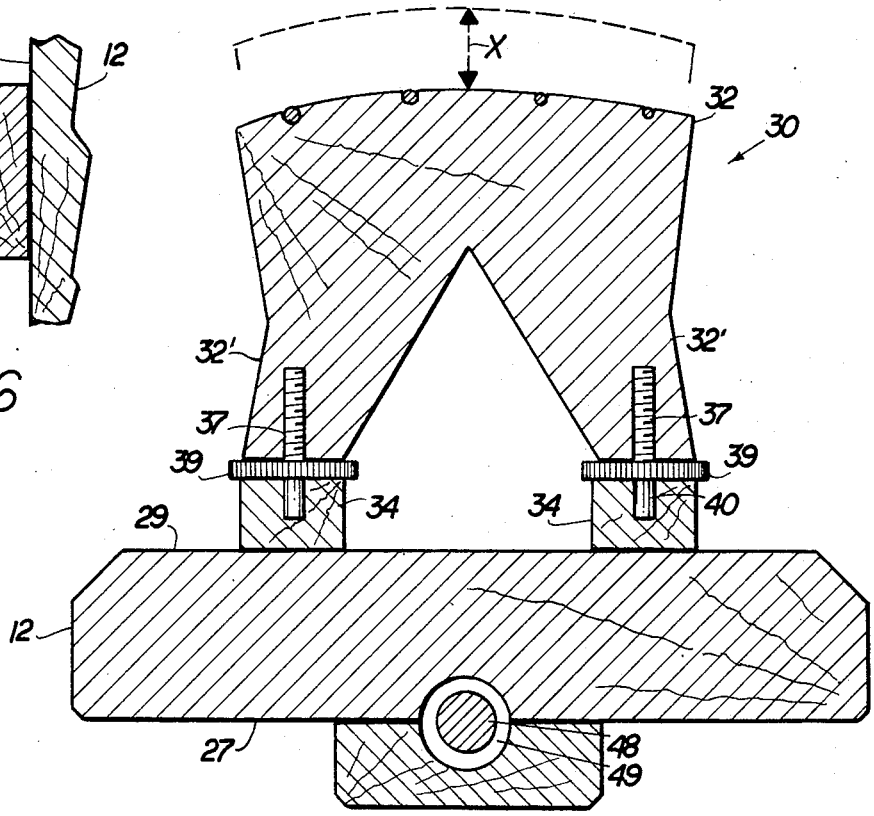
FIG. 7 is a sectional view along line 7—7 of FIG. 1 showing structural details of a bridge assembly of the present invention.

Other structural features of the subject instrument 10 include an elongated fingerboard 28 extending downwardly from the head portion 16 along the length of neck 1 and approximately midway along the length of the body 12. The fingerboard 28 is disposed in at least partially overlying relation to the front face 29 of body 12 especially as at 29' and in underlying and engageable disposition relative to the major length of the string assembly including one or more strings 22. With primary reference to FIGS. 1, 2, 7 and 8, the subject instrument 10 includes a bridge means 30 including an outwardly extending bridge plate 32 and a fixedly secured base 34 attached to the front face 29 of the body 12. The base 34 serves as an anchor or support to the outwardly extending bridge plate 32, wherein the bridge means 30 further includes an adjustment means generally indicated as 35. With reference to FIG. 7, the adjustment means 35 includes an externally threaded fastener element 37 mounted on the interior of each leg element 32' of bridge plate 32. Turning knobs 39 are fixedly secured to each of the threaded rods 37 and an anchoring post 40 is appropriately anchored or mounted in the base 34. Accordingly, upon rotation of the knobs 39 in the appropriate direction, the outward distance of extension of the bridge plate 32 from the front face 29 may be varied in accordance with the directional arrow X in FIG. 7.

Figure 8:
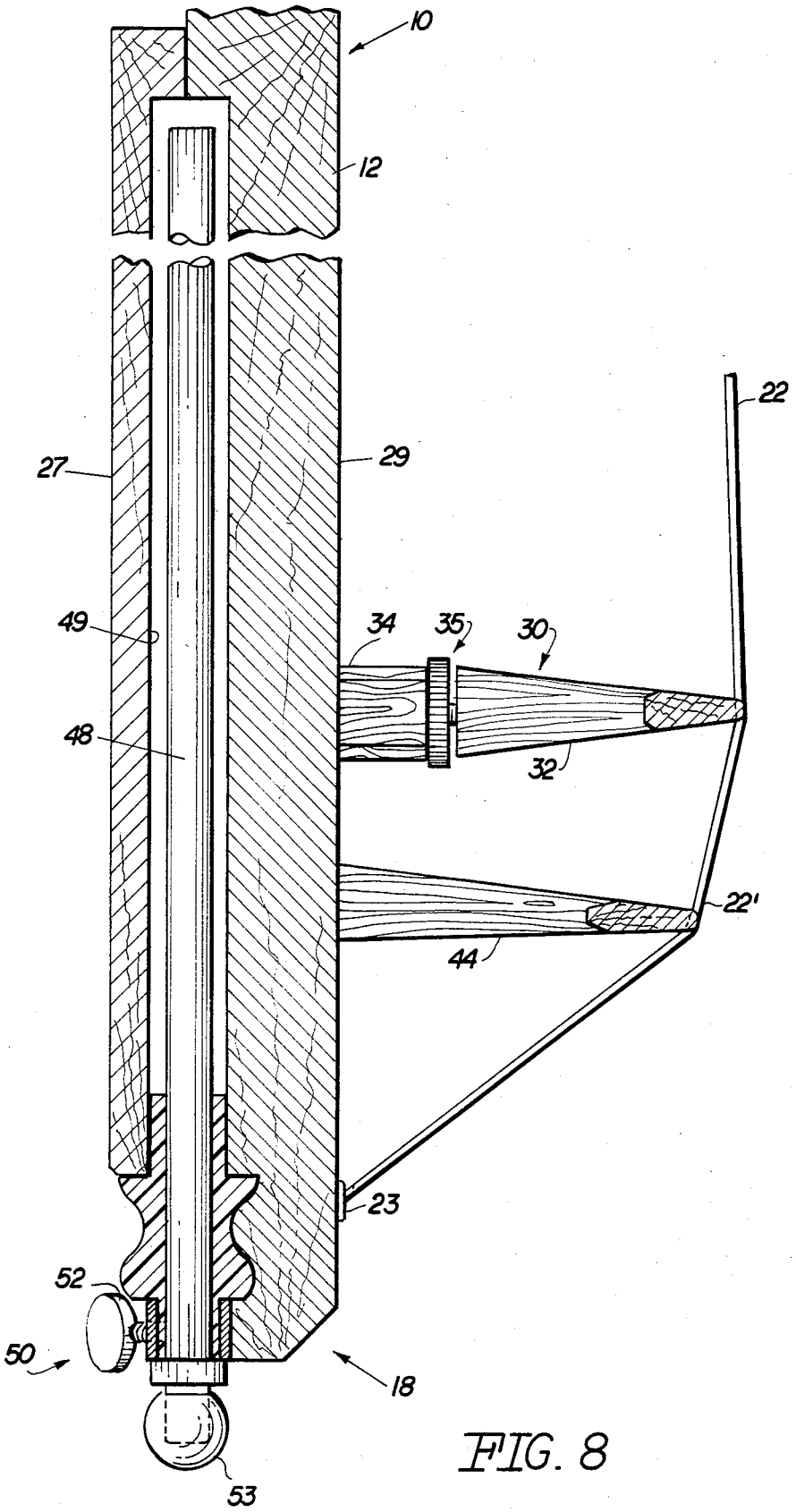
FIG. 8 is a sectional view along line 8—8 of FIG. 3 showing interior structural details of the support rod of the present invention disposed in its stored or collapsed position.

An additional important structural feature of the present invention is the provision of a string tensioning means as best shown in FIG. 8 which includes a tensioning plate 44 extending outwardly from the front face 29 and disposed between the connecting means comprising the plurality of apertures 23 and the bridge plate 32. The tensioning plate 44 extends outwardly from the front face 29 a lesser distance than the bridge plate 32 but is disposed in substantially parallel relation thereto so as to provide additional tension on strings 22 as at 22' between the bridge means 32 and the connecting means including a plurality of apertures 23. Accordingly, the plurality of strings 22 are tensioned successively by the bridge plate 32 and tensioning plate 44 at varying, outwardly extending distances from the front face 29. The provision of the tensioning plate 44 in combination with the manner in which the ends of the strings 22 are secured to the plurality of connecting apertures and to the rear surface 27 of the body 12 serves to provide quality tonal characteristics even in the absence of a floating anchor plate which is commonly used on stringed instruments of the type referred to herein.

Other structural features of the present invention comprise a support means generally indicated as 46 and including an elongated support rod 48 positionable in a stored or collapsed position as shown in FIG. 8. The chamber 49 is of substantially the same or greater longitudinal dimension than the elongated support rod 40. A locking mechanism generally indicated as 50 in the form of a thumb screw element 52 is extendible inwardly into abutting relation with the exterior surface of the support rod 40 thereby allowing its outward extension at any of a variety of lengths up to its full extended position such that knob element 53 engages a supporting surface 54 so as to maintain the instrument 10 in an upstanding position and at varying heights. This in turn allows the playing of the instrument 10 in a variety of positions such that the musician may be totally upstanding or seated depending upon the desired and selected length of the support rod and distance the rod extends outwardly from the bottom or opposite end 18 of the body 12.

Figure 5:
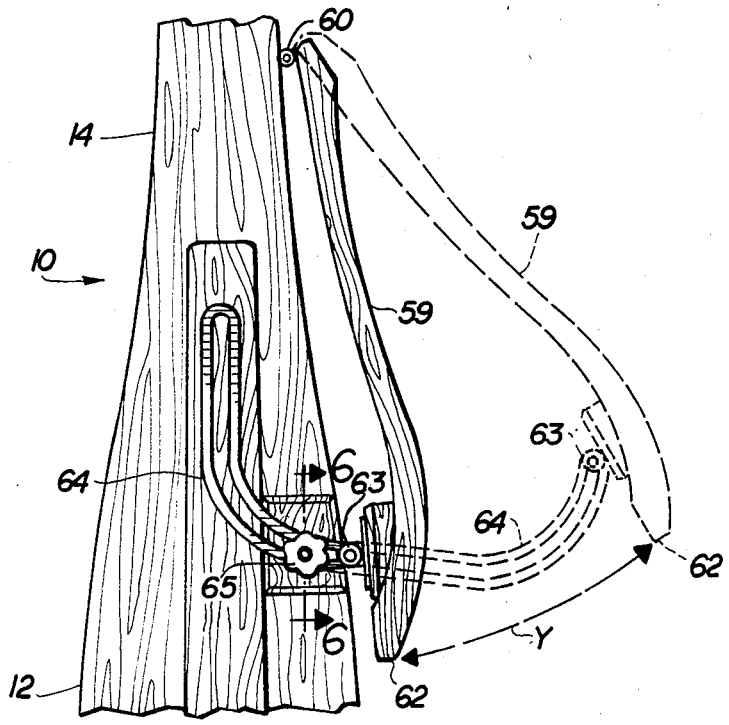
FIG. 5 is a detail view of strutural means used to outwardly position and maintain the width adjusting arm of FIG. 4 as shown along 5—5 of FIG. 3.
Figure 6:
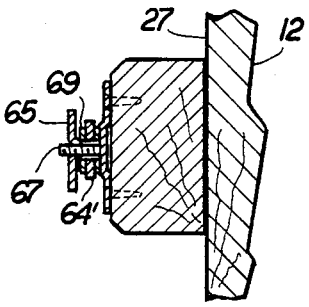
FIG. 6 is a sectional view along line 6—6 of FIG. 5.

Other structural features of the present invention include a width adjusting means generally indicated as 58 in the form of an arm member 59 having one end pivotally secured as at 60 to one side of the instrument 10. The opposite end as at 62 is positionable in an outwardly extending spaced apart relation to the corresponding side of the body 12 as indicated by directional arrow Y. A track structure 64 is pivotally secured to the arm 59 as at 63. The track structure 64 has an elongated and substantially curvilinear configuration and slides along its length relative to a tightening or locking knob structure 65. As shown in FIGS. 5 and 6, the track structure 64 has an open longitudinal channel which allows passage of each leg or finger 64' of the track structure 64 to pass on opposite sides of a locking shaft 67. Tightening of knob 65 serves to secure or affix washer or bushing elements 69 in fixed frictional engagement with the portion 64' of the track structure 64 so as to maintain the arm 59 in a preferred outwardly extending position. It is readily apparent that the arm 59 is outwardly positioned at any of an infinite number of distances from the side of the instrument 10 so as to appropriately be positioned for cooperative engagement with the body of the musician when playing the instrument as is similar to the technique used in playing a conventional acoustical bass. In order to adapt to such engagement by the body of the musician, the arm 59 has an elongated and substantially curvilinear configuration as clearly shown.

It should be emphasized that the subject instrument, as generally described herein, can be made of material other than wood, such as metal, plastic, or any material demonstrating sufficient rigidity and strength. Also, the specific size and shape of the subject instrument can vary according to the particular needs, desires, and requests of an individual musician. Accordingly, while a preferred embodiment of the instrument 10 may have specific dimensional characteristics, as follows, such dimensions as well as the overall configuration may of course be varied and still fall within the intended scope of the present invention. A preferred instrument 10 may have a height from the outer extremity of head portion 16 to the opposite end as at 18 of 55 inches. The overall height of the instrument 10 can be extended by varying increments up to the total length of the stick or support rod 48 which is approximately 30 inches. The width of the bass at approximately its widest point is 7.5 inches and the bridge plate 32 extends outwardly from the surface 29 an adjustable amount but normally in the range of 6.5 inches. Again, such outer extension can be varied by operation of the adjustment means as set forth above. The overall thickness of the bass varies up to substantially 2 inches. Again, any of the above specific dimensional features may be varied as well as the overall configuration so as to accommodate and meet the standards and desires for an intended function and of an individual musician.

It is therefore to be understood that the following claims are intended to cover all of the generic and specific features of the invention herein described, and all statements of the scope of the invention which, as a matter of language, might be said to fall therebetween.

Now that the invention has been described,

What is claimed is:

1. A stringed musical instrument of the type primarily designed for selective variance of its overall size to facilitate handling and versatility in playing positions, said instrument comprising:

(a) a body including a front face and having an elongated neck extending outwardly therefrom substantially along the longitudinal axis of said body, (b) a string assembly including at least one string extending along said body between opposite ends thereof and in exposed disposition and overlying relation to said front face, (c) a head portion secured to a distal end of said neck and defining one of said opposite ends of said body, a connecting means formed on said body adjacent the other of said opposite ends, (d) a fingerboard mounted to extend along the length of said neck and a portion of said body and in overlying relation thereto and in underlying engageable disposition relative to said string assembly, (e) a bridge means secured to said body and extending outwardly from said front face in engagement with said string assembly, (f) string tension means secured to said body in spaced apart relation to and between said bridge means and said connecting means and extending outwardly from said front face in a common direction to said bridge means, (g) said string assembly suspended outwardly from said front face and said fingerboard successively at varying distances by said bridge means and said string tension means respectively, (h) support means secured to said other opposite end of said body and structured to support of said body on a given surface, said support means extendable outwardly from said body to variable lengths and selectively positionable relative to said body, (i) said body comprising a substantially fixed longitudinal dimension extending from said head portion to said other opposite end of said body, said body further comprising a variable overall length dependent on the length of extension of said support means from said other opposite end, and (j) width adjusting means for varying an effective lateral dimension of said body and comprising an arm having an elongated configuration shaped for cooperative engagement with a player, said arm having one end pivotally secured to said body and an opposite end positionable outwardly from one side of said body in selectively varying distances from said body.

2. An instrument as in claim 1 wherein said arm comprises an elongated and substantially partially curvilinear configuration shaped for cooperative engagement with a player's body.

3. An instrument as in claim 1 wherein said support means comprises an elongated rod selectively positionable outwardly from said body in a direction common to the longitudinal axis thereof and along its own length and inwardly into and substantially telescoping relation on the interior of said body.

4. An instrument as in claim 1 wherein said fingerboard has a longitudinal dimension substantially equal to a conventional acoustical instrument of the same type and extends from said head to substantially midway along said body and in spaced relation to said bridge means.

5. An instrument as in claim 1 wherein said connecting means comprises aperture means integrally formed in said body at said other opposite end thereof and extending therethrough, said aperture means structured and dimensioned for passage of at least said one string therethrough, said one string secured to an undersurface of said body adjacent said aperture means.

6. An instrument as in claim 5 wherein said string assembly comprises a plurality of strings extending from said head portion to said connecting means, said aperture means comprising a plurality of spaced apart apertures each extending through said body at said other opposite end, each aperture structured and dimensioned to receive therethrough one of said plurality of strings and each of said strings secured to said undersurface of said body adjacent a respective one of said apertures.

7. An instrument as in claim 1 wherein said width adjusting means further comprises a track structure having an elongated configuration and secured to said opposite end of said arm and movable relative to said body, locking means for regulating the position of said track structure relative to said body and mounted on said body and selectively movably and fixedly interconnecting said track structure slidably engaging said locking means along the length of said track structure and being fixedly positionable thereto upon secured position of said locking means.

8. An instrument as in claim 1 wherein said bridge means comprises a bridge plate extending outwardly from said front face and in suspending, interruptive engagement with said string assembly and a base fixedly secured to said front face and in supporting engagement with said bridge plate; said bridge means further including an adjustment means movably interconnecting said bridge plate to said base and said body and structured for regulating a distance of outer extension of said bridge plate from said front face.

9. An instrument as in claim 8 wherein said string tension means comprises a tension plate disposed in spaced apart and substantially parallel relation to said bridge plate and extending outwardly from said front face into suspending engagement with said string assembly a lesser distance than said bridge plate.

10. An instrument as in claim 9 wherein said connecting means comprises aperture means integrally formed in said body at said other opposite end and extending therethrough, said aperture means structured and dimensioned for passage of at least said one string therethrough, said one string secured to an underside of said body adjacent said aperture means.

11. An instrument as in claim 10 wherein said string assembly comprises a plurality of strings extending from said head to said connecting means, said aperture means comprising a plurality of spaced apart apertures each extending through said body at said other opposite end, each aperture structured and dimensioned to receive passage therethrough of one of said plurality of strings and each of said strings secured to said undersurface of said body adjacent a respective one of said apertures.

12. An instrument as in claim 1 wherein said string tension means comprises a tension plate disposed in spaced apart and substantially parallel relation to said bridge means and extending outwardly from said front face and into suspending engagement with said string assembly at a lesser distance from said front face than said bridge means.

13. An instrument as in claim 1 wherein said head portion comprises a tuning peg assembly mounted thereon and including one tuning peg for each string of said string assembly, each of said tuning pegs structured to have a correspondingly positioned opposite end of one string secured thereto and said peg extending outwardly in substantially transverse relation to an exposed front surface of said head portion.

* * * * *